United States Patent [19]

Krolski et al.

[11] 4,233,950

[45] Nov. 18, 1980

[54] SAFETY INTERLOCK FOR AN ENGINE IGNITION SYSTEM

[75] Inventors: Kenneth L. Krolski, Cedarburg, Wis.; John N. MacLeod, Ann Arbor, Mich.

[73] Assignee: Tecumseh Products Company, Tecumseh, Mich.

[21] Appl. No.: 32,870

[22] Filed: Apr. 24, 1979

Related U.S. Application Data

[63] Continuation of Ser. No. 736,315, Oct. 28, 1976, abandoned.

[51] Int. Cl.[3] ..... F02P 3/08; F02P 1/08; F02B 77/08

[52] U.S. Cl. ..... 123/630; 123/599; 123/146.5 B; 123/149 D; 123/198 D

[58] Field of Search ..... 123/198 D, 198 B, 198 DC, 123/198 CC, 148 S, 149 D, 148 E, 146.5 B, 146.5 A

[56] References Cited

U.S. PATENT DOCUMENTS

| | | | |
|---|---|---|---|
| 3,362,388 | 1/1968 | Lindberg et al. | 123/198 D |
| 3,428,033 | 2/1969 | Watts | 123/146.5 A |
| 3,490,426 | 1/1970 | Farr | 123/149 D |
| 3,521,612 | 7/1970 | Santi et al. | 123/198 D |
| 3,718,128 | 2/1973 | Botker | 123/148 E |
| 3,726,265 | 4/1973 | Howard | 123/148 S |
| 3,980,068 | 9/1976 | Karsten et al. | 123/198 DC |
| 4,033,311 | 7/1977 | Burson | 123/198 D |
| 4,056,088 | 11/1977 | Carmichael | 123/148 E |

FOREIGN PATENT DOCUMENTS

| | | | |
|---|---|---|---|
| 1259941 | 1/1972 | United Kingdom | 123/198 B |

*Primary Examiner*—P. S. Lall

*Attorney, Agent, or Firm*—Albert L. Jeffers; Roger M. Rickert

[57] ABSTRACT

In a capacitor-discharge breakerless ignition system for an internal combustion engine, a safety interlock comprising a rectifier and a switch responsive to a preselected unsafe vehicle condition is connected in the charge circuit of the ignition capacitor. The rectifier is poled in the forward capacitor charge-voltage direction and is connected with respect to the switch such that the capacitor is not charged or, once charged, is discharged prior to engine ignition in response to an unsafe condition indicated by the switch, or in response to intentional or accidental breakage and/or short-circuiting of interlock/ignition interconnection leads. The rectifier and the switch are packaged in such a manner, preferably separate from the rest of the ignition, to deter tampering with the switch alone, and to permit locating the switch and rectifier remote from the ignition circuit. In one preferred application the rectifier-switch package is mounted on the handle of a rotary lawn mower to serve as a deadman switch.

12 Claims, 8 Drawing Figures

SAFETY INTERLOCK FOR AN ENGINE IGNITION SYSTEM

This is a continuation of application Ser. No. 736,315, filed Oct. 28, 1976, now abandoned.

The present invention relates to ignition systems for internal combustion engines and, more particularly, to a safety interlock system for preventing or terminating ignition of an internal combustion engine upon occurence of an unsafe condition. Yet more specifically, the invention relates to deadman switches and ignition safety interlocks for rotary lawn mowers.

Safety interlock systems of the above-described type may soon be required on various engine-powered consumer products, such as snowblowers and lawn-and-garden vehicles (e.g., lawn mowers and garden tractors), in accordance with Federal and/or State safety regulations. In prior art safety interlock systems, a sensor or switch is usually disposed on the vehicle associated with the engine to detect an unsafe condition, for example the condition at a mower blade, the mower handle, the driver's seat or the drive train. Typically, the switch may be electrically connected to the ignition system to prevent or terminate ignition when an unsafe condition is sensed, as for example, to short the charge coil to ground in the case of capacitor-discharge ignitions. A problem common to most, if not all, prior art interlock systems is that the interlock may be defeated inadvertently, as by accidental cutting or breaking of the interlock/engine interconnection wires or by a short-circuit between one or more of the wires to chassis ground. Moreover, such systems may often be readily defeated by an operator in a deliberate, if misguided, attempt to make vehicle operation seemingly more convenient.

For practical commercialization it is also important that the interlock be low in cost, particularly with small engines on the order of three to five horsepower. These engines in particular are mass produced to sell at low cost for high volume applications, such as on rotary lawn mowers.

Objects of the present invention are to provide a safety interlock system which is inexpensive in manufacture and reliable and effective in operation, which is useful in connection with a wide variety of ignition systems, which will readily accommodate any number of interlock switches responsive to varied safety conditions, and/or which cannot be readily defeated either by accident or on purpose.

It is another object of the present invention to provide a safety interlock system which is specifically adapted for and finds particular advantage in connection with an ignition system of the breakerless, capacitor-discharge type used on rotary lawn mowers.

The novel features which are considered to be characteristic of the present invention are set forth in particular in the appended claims. The invention itself, however, together with additional objects, features and advantages thereof, may be best understood from the following description when read in conjunction with the accompanying drawings in which:

Figure 1:
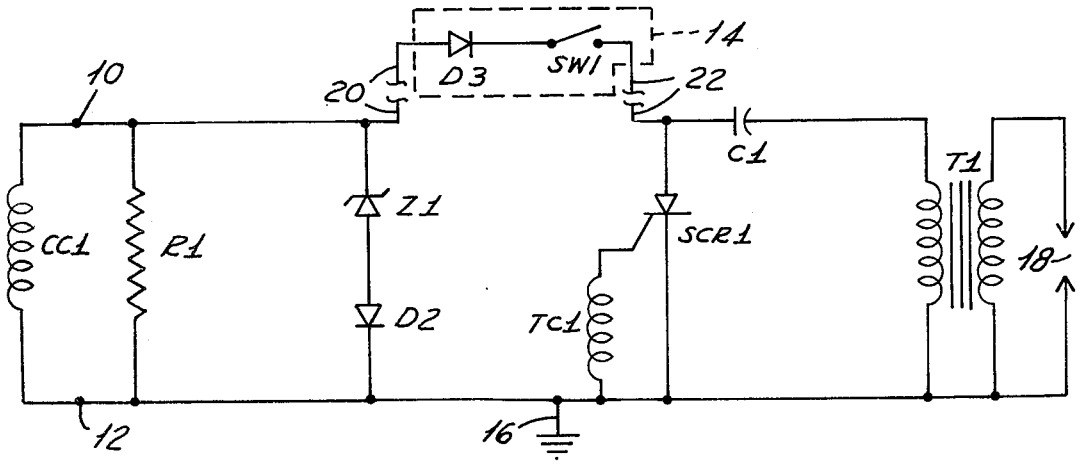
FIG. 1 is a schematic diagram of one presently preferred embodiment of the interlock system according to the invention and is shown in combination with a generally conventional capacitor-discharge, breakerless ignition system.

Referring to FIG. 1, an ignition charge coil CC1 is disposed in proximity to a flywheel (not shown) and is responsive to the periodic passage of a permanent magnet carried by the flywheel to develop an alternating voltage signal between coil terminals 10,12. A high-impedance resistor R1, preferably on the order of one hundred fifty thousand ohms, is connected across charge coil terminals 10,12. The series combination of a reverse-polarized zener diode Z1 and a rectifier or diode D2 is connected between terminals 10,12 to limit the forward open circuit voltage in coil CC1. Terminal 10 is connected through a diode D3 and a switch SW1 to the anode of a silicon controlled rectifier SCR1 which has its cathode connected to ground 16 at coil terminal 12. In accordance with one feature of the invention, diode D3 and switch SW1 form an interlock circuit 14 and are packaged together for remote positioning as will be described in connection with the preferred application on a rotary lawn mower. A trigger coil TC1 is connected between the gate of rectifier SCR1 and ground 16 and may, for example, be disposed in proximity to a flywheel magnet (not shown) to provide an appropriate trigger signal. Other appropriate triggering arrangements could be used, as is well known in the art. A main storage capacitor C1 and the primary of an ignition coil T1 are serially connected between the anode of rectifier SCR1 and ground 16. The secondary of ignition coil T1 is connected to a spark plug schematically depicted at 18.

Operation of the ignition circuit shown in FIG. 1 will be generally self-evident to persons skilled in the art in view of the James B. Farr U.S. Pat. No. 3,838,671, for example. In summary, rotation of a flywheel magnet past coil CC1 develops an alternating signal at terminals 10,12 with the positive half cycle charging capacitor C1 through interlock D3, SW1 and the primary of coil T1. At a preselected time in the engine cycle a flywheel magnet induces a triggering signal in coil TC1 which turns on rectifier SCR1 to discharge capacitor C1 through the primary of ignition coil T1 and thereby produce a spark at plug 18. Resistor R1 has no appreciable effect during the charge half-cycle because of its high impedance relative to the parallel charge path through capacitor C1 and coil T1. Discharge of capacitor C1 through resistor R1 is normally blocked by diode D3. If switch SW1 is open, the open circuit charge voltage developed in coil CC1 is effectively clamped by zener Z1 to a preselected limit.

Pursuant to one important aspect of the present invention, diode D2 is provided to prevent current from flowing through zener Z1 in the reverse voltage direction of coil CC1. It has been found that, when high reverse current is permitted to pass through zener Z1 as in the above-referenced Farr patent, the inductance of coil CC1 tends to sustain such reverse current even after the reverse voltage has disappeared. If it is then attempted to charge capacitor C1, the sustained reverse current in coil CC1 will be in opposition to the induced charge flux and will appreciably reduce the amount of charge transferred to capacitor C1. Diode D2 blocks such high reverse current and a relatively low reverse current is permitted to pass through resistor R1 to limit reverse voltage.

In the embodiment of the invention illustrated in FIG. 1, interlock 14, comprising diode D3 and normally-open condition-responsive safety switch SW1, is located on a vehicle remotely of the ignition circuit and connected between coil terminal 10 and the anode of rectifier SCR1 by the respective leads 20,22. From the foregoing discussion, it will be recognized that diode D3 (in addition to the interlock function of this invention) also serves as a conventional charging rectifier, i.e., diode D3 is connected in the charging path between coil CC1 and capacitor C1 to pass the positive half cycles, to prevent the charge on capacitor C1 from discharging through coil CC1 and to isolate capacitor C1 from the opposite (negative) polarity half cycles generated at coil CC1.

Interlock 14, which includes switch SW1, may comprise any one of the usual safety interlock switches such as, for example, a "deadman" switch located on the vehicle and responsive to a preselected condition indicating inability of the operator to control the vehicle to thereby prevent or terminate ignition. For example, referring to FIGS. 7 and 8, interlock 14 may be disposed on the operator handle 30 of a self-propelled lawn mower 32 which further comprises a low-horsepower internal combustion engine 34 mounted by bolts 36 to a carriage deck or blade housing 38. Four wheels 40 are rotatably mounted to housing 38, the rear wheels being driveably coupled to engine 34 by a suitable clutch (not shown). A chute 42 is formed on housing 38 for guiding grass clippings or the like out of the housing, suitable means being provided at the chute exit for mounting a conventional grass catcher or bag (not shown). A pull-rope recoil starter 44 is carried by engine 34. Engine 34 includes a capacitor-discharge electronic ignition of the type depicted in FIG. 1. Handle 30 is pivotally mounted to housing 38. A starter handle 46 is carried by mower handle 30 and is connected to starter 44 by a pull-rope 48 trained through guides 50 mounted on the mower handle.

Figure 8:
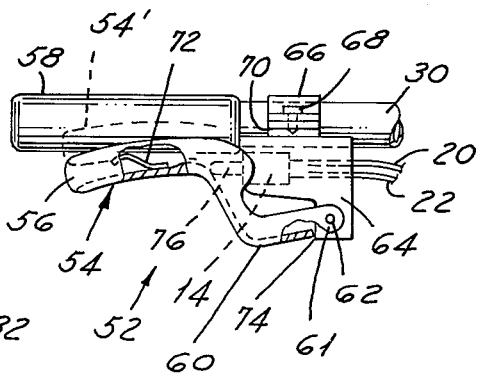
FIG. 8 is an enlarged view of a deadman switch and switch actuator on the lawn mower of FIG. 7.

A deadman safety device 52 is mounted on mower handle 30 and comprises a generally Z-shaped lever 54 stamped from a single piece of sheet metal stock and having a semicircular cross section viewed transversely of any of its contiguous legs. Lever 54 has a first free leg 56 carried adjacent one handle grip 58, the radius of cross sectional curvature of lever 54 being such that leg 56 will overlie hand grip 58 coaxially therewith when gripped by a mower operator. A second free leg 60 terminates in a pair of opposed axially extending ears 61 which are pivotally mounted by a pin 62 to a bracket 64, as best seen in FIG. 8. Bracket 64 is mounted to handle 30 by means of a clamp 66 and suitable screws 68 threadably received into corresponding ears 70 on bracket 64 to hold bracket 64 stationary relative to the handle. A spring 72 is carried internally of leg 56 and biases lever 54 to the normal or rest position spaced from hand grip 58, as shown in solid lines in FIG. 8. The bight of hollow leg 60 is dimensioned to cooperate with bracket 64 to form a stop 74, and to thus limit movement of lever 54 away from hand grip 58.

Interlock 14, comprising switch SW1 and diode D3 (FIG. 1), is mounted in an encapsulated enclosure within bracket 64, switch SW1 including a spring-biased actuator 76 extending from bracket to engage lever 54. Insulated conductors 20,22 connect interlock 14 to the engine ignition as schematically depicted in FIG. 1. When lever 54 is in the rest position depicted in solid lines in FIGS. 7 and 8, the interlock switch is in the normally-open condition shown in FIG. 1. Preferably, the sides of leg 60 are shaped to closely overlap bracket 64 to prevent access to actuator 76 in all positions of lever 54. When lever 54 is gripped by an operator and moved against the force of spring 72 to the actuated position indicated in phantom in FIG. 8 at 54', actuator 76 is depressed and switch SW1 (FIG. 1) is closed. Thus, an operator may assume a position behind handle 30 as viewed in FIG. 7, i.e., a safe distance away from the mower blade (not shown) beneath housing 38, may grip lever 54 with one hand to pull the same into the dotted line position shown in FIG. 8, and thereby actuate switch SW1. Then, while maintaining handle 54 in this "run" position, the operator may start engine 34 by pulling handle 46 and thus rope 48 with his other hand. With switch SW1 thus held closed, and thereby indicating a safe condition, and with leads 20,22 properly routed and connected as shown in FIG. 1, charging current will be fed from coil terminal 10 (FIG. 1) through lead 20, diode D3, switch SW1 and lead 22 to capacitor C1, and engine ignition may proceed as described above. However, if lever 54 is released by the mower operator, such action is interpreted as indicating that the operator has left the desired safe position behind handle 30. When thus released, lever 54 is moved by spring 72 against stop 74 and switch SW1 is opened, thereby indicating such an unsafe condition and blocking charging current from capacitor C1.

In the preferred form of the invention, diode D3 and switch SW1 are encapsulated or otherwise packaged within an integral temperproof structure with only the leads 20,22 and actuator 76 exposed. In this form of the invention, the interlock cannot be readily defeated by either accidental damage to one of the leads or by operator tampering. More specifically if either one or both of the leads 20,22 is cut and/or short circuited to ground, capacitor C1 will not receive charge current from coil CC1. If the mower operator attempts to defeat the interlock by electrically short circuiting lead 20 to lead 22, charge will collect on capacitor C1 from coil CC1 through such short circuit, but will then be dissipated or discharged through coil CC1 in parallel with resistor R1 before rectifier SCR1 is triggered.

It will be recognized, of course, that the present invention operates to best advantage when the time interval between the charge and trigger signals is long enough to allow capacitor C1 to discharge through coil CC1 and resistor R1 below a minimum level required for engine ignition. The required discharge time will, of course, depend upon the capacitance of capacitor C1 and the d.c. resistance of coil CC1 and resistor R1, as well as upon the minimum signal characteristics required at coil T1 to induce a spark at plug 18. The embodiment of the invention described herein in connection with FIG. 1 is considered to be useful with or readily adaptable for use with most conventional capacitor-discharge ignition systems. The time required for charge dissipation will be significantly reduced where capacitor C1 is charged on the first half cycle of the signal in coil CC1, the second half cycle being normally dissipated through resistor R1. When interlock leads 20,22 are short circuited in such a system, the second half cycle of the charge signal rapidly reverses the charge on capacitor C1, which reversed charge will then be dissipated through resistor R1 and will be unaffected by triggering of rectifier SCR1.

From the foregoing description it will be apparent that the interlock system provided by the present invention and thus far described in connection with FIGS. 1 and 7–8 achieves all of the objects and aims set forth above. For example, interlock 14 represents very little increase in cost over a conventional interlock switch and ignition circuit, involving merely the disposition of diode D3 within the switch enclosure instead of in the ignition circuit. When switch SW1 and diode D3 are disposed within an integrally encapsulated structure, as is preferred, such structure cannot be readily opened, examined and defeated by an operator. Such structure may comprise the usual sealed plastic switch housing with the diode included therein and only the switch actuator and leads extending therefrom. An operator can defeat the interlock so provided only by opening the switch structure and short circuiting switch SW1, or by connecting a separate diode across the interlock. However, the latter alternative would require that the operator obtain a working knowledge of the internal circuitry of the encapsulated switch structure which need only be disclosed in "black box" form in an operator's manual, so that, again, the operator would have to open the switch to learn the circuit details thereof.

Figure 7:
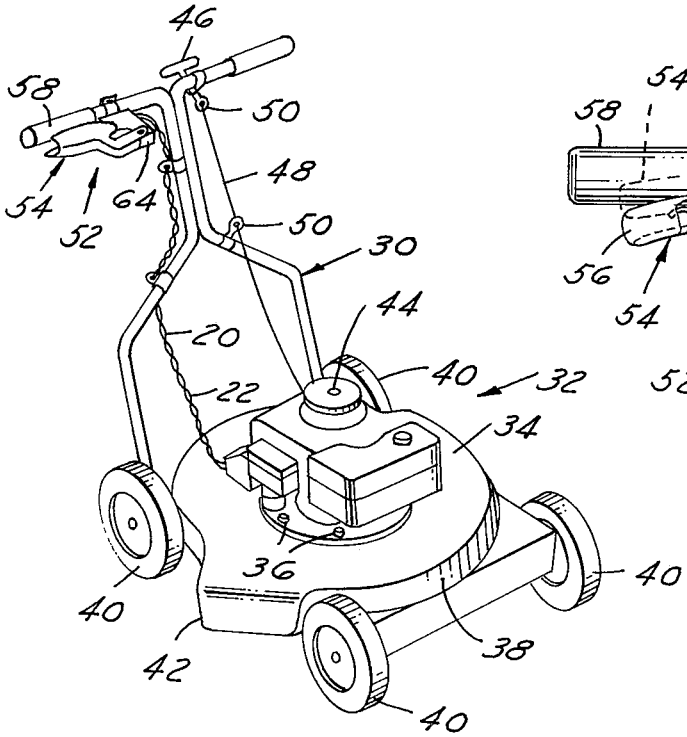
FIG. 7 is a perspective view of a rotary lawn mower equipped with an ignition safety interlock in accordance with the invention.

In connection with the preferred embodiment of the invention shown in FIG. 1 and further illustrated in FIGS. 7–8, interlock 14 has been disclosed as being disposed remotely of the remainder of the ignition circuit and connected thereto by leads 20,22. This form of the invention is preferred because it allows switch SW1 to be located in proximity to the mechanism to which it is responsive, i.e., in proximity to lever 52 in FIGS. 7 and 8. It will be evident, however, that interlock 14, comprising switch SW1 and diode D3, could be located at the ignition circuit and be made responsive to lever 52 through a Bowden cable, for example. In the latter form of the invention, the switch and diode could be enclosed within an epoxied ignition circuit with only a switch actuator extending therefrom. The required cable is considered to be highly subject to tampering, however, and for this reason the remote interlock is presently preferred.

It will be apparent that voltage-limiting circuits other than the resistor/diode combination of FIG. 1 may be used, such as opposed serially-connected zener diodes, whereby the voltage limit in either direction is determined generally by the corresponding diode. However, the resistor/diode voltage-limiting circuitry depicted herein not only cooperates with the charge coil in dissipating charge on the capacitor in one of the preselected unsafe interlock conditions, but also optimizes charge transfer to capacitor C1 as described above. It is also feasible in some applications to provide in place of resistor R1 and diodes Z1, D2 two parallel combinations of a resistor and series diode, with the diodes being alternately polarized. However, the use of resistor rather than zener voltage limiting in the charge direction is considered to be disadvantageous in many applications when low speed starting is desired, such as on a lawn mower for example.

Figure 2:
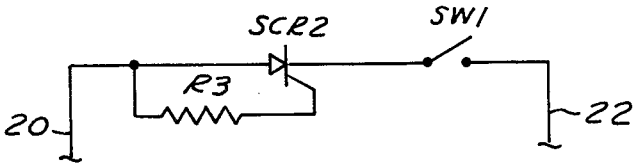
FIGS. 2–6 are alternative embodiments of the interlock system schematically depicted in FIG. 1.

Although the invention has been described in connection with a specific embodiment thereof, many alternatives and modifications will be apparent to the skilled artisan. For example, referring to FIG. 1, where it is desired to charge capacitor C1 on the negative rather than the positive polarity between coil terminals 10,12, zener Z1 and diode D2 may be reversed, and leads 20,22 may be reversed effectively reversing diode D3. Moreover, it will be apparent that the interlock rectifier may be other than a diode D3, where suitable. For example, the interlock may comprise switch SW1 connected in series with the anode-cathode circuit of silicon controlled rectifier SCR2, as depicted in FIG. 2, with a resistor R3 connected between the anode and gate of rectifier SCR2 to bias the rectifier into conduction. Or the interlock may comprise switch SW1 connected in series with the collector-emitter circuit of a transistor Q1, as illustrated in FIG. 3, with a resistor R4 connected between the transistor collector and base to bias the transistor into conduction.

Figure 3:
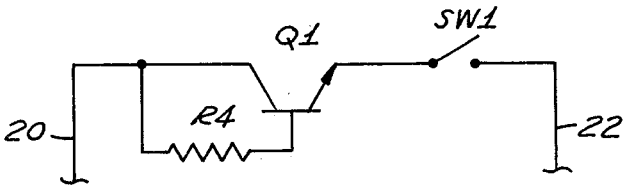
Figure 4:
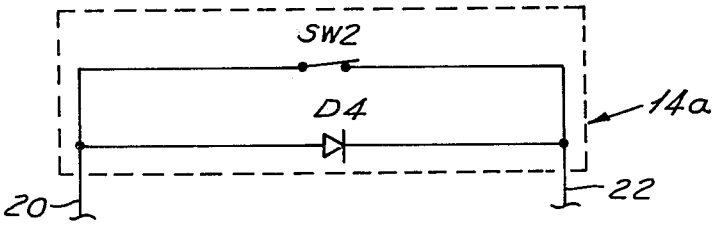

In some applications it may be desirable to provide a normally-closed interlock switch rather than a normally-open switch SW1 as depicted in FIGS. 1–3. A modified interlock circuit 14*a* of this type is depicted in FIG. 4 and comprises a normally-closed interlock switch SW2 and a diode D4, preferably disposed within the encapsulated switch structure, connected in the forward voltage direction across switch SW2. During normal operation, i.e., in the absence of an unsafe condition, switch SW2 is open and charge current is fed to capacitor C1 (FIG. 1) through lead 20, diode D4 and lead 22. As already discussed in connection with FIG. 1, diode D4 acts to block discharge of the charge collected on capacitor C1. Where an unsafe condition exists, however, and switch SW2 is closed, the charge collected on capacitor C1 will dissipate through switch SW2 and coil CC1 (FIG. 1) before the trigger signal to rectifier SCR1.

It will be apparent that the modification shown in FIG. 4 possesses all of the economic and operational advantages previously discussed in connection with the embodiment of FIG. 1. Moreover, it will be evident that the embodiment of FIGS. 1 and 4 are fully compatible with each other, and may be combined where it is desirable to use both a normally-closed and a normally-open safety interlock switch. Furthermore, it will be apparent that a plurality of normally-closed and/or normally-open interlock switches may be interconnected, in series for normally-open switches and in parallel for normally-closed switches, to form a complex interlock system of any desired configuration. The mechanical details of the encapsulated interlock switch and rectifier structure shown schematically in the various figures herein will be self-evident from the foregoing disclosure, and are primarily a matter of design choice for the skilled artisan depending upon the particular location and application for the switch.

Figure 5:
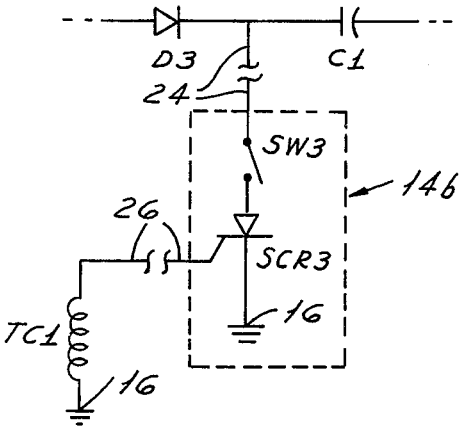

In the various forms of the present invention hereinabove described, the safety interlock has been connected in the charge path of capacitor C1. However, the invention contemplates other modifications, such as that depicted in FIG. 5 wherein the interlock, designated 14*b*, is connected in the capacitor-discharge circuit path. More specifically, one terminal of a normally-open switch SW3 is connected by lead 24 to the junction of diode D3 and capacitor C1 in the ignition circuit. The other terminal of switch SW3 is connected to the anode of the ignition rectifier SCR3 which has its cathode connected to ground (e.g., the engine block or frame) and its gate connected by lead 26 to trigger coil TC1. When switch SW3 is closed, the modified ignition depicted in FIG. 5 operates normally with SCR3 periodically discharging capacitor C1 to achieve engine ignition. Should either or both of leads 24,26 become opened and/or short circuited to ground, the ignition circuit will not function because discharge rectifier SCR3 will have been effectively removed from the circuit. Similarly, if leads 24,26 are connected together in an effort to defeat the interlock, the ignition will not operate because charge current to capacitor C1 will be fed to the gate of rectifier SCR1 and turn on the rectifier to thereby short circuit the charge current to ground 16. Although the modification of FIG. 5 embodies many of the advantages hereinabove discussed, such modification is not presently preferred because it requires that discharge rectifier SCR3 be located remotely of the ignition and encapsulated, which may render the SCR difficult to heatsink, and because a high voltage (about two hundred volts) would be retained on capacitor C1 when interlock **14*b*** is open. Such high voltage would not become excessive because of the voltage limiting provided by zener Z1, but neither would it be dissipated because of diode D3.

It will be recognized that a normally-closed, open-to-run safety switch may be additionally or alternatively connected in parallel and encapsulated with rectifier SCR3. Operation of such modification will be generally similar to that described in connection with interlock **14*b*** with the exception that charge current will be short circuited to ground when the interlock switch is not activated.

Figure 6:
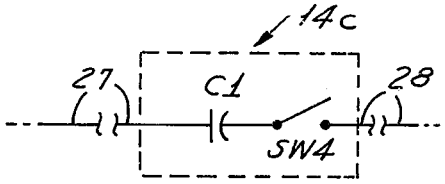

Yet another modification **14*c* of the basic safety interlock provided herein is depicted in FIG. 6, wherein a normally-open switch SW4 is encapsulated integrally with ignition capacitor C1. When switch SW4 is open, indicating an unsafe condition, the charge path of capacitor C1 is also open and the capacitor will not be charged. When switch SW4 is closed, ignition may proceed as described above. When either or both of the interconnection leads 27,28 is open, the effect is the same as if switch SW4 were open. If leads 27,28 are connected to each other, then capacitor C1 is short circuited and charge cannot be collected thereon. Should lead 28 be short circuited to ground, such short circuit will be in parallel with ignition coil T1 (FIG. 1) such that charge will collect on capacitor C1 but will not discharge through the ignition coil. The modification of FIG. 6 includes the important features of the invention in that interlock 14*c* cannot be readily defeated. However, interlock 14*c* possesses a significant disadvantage, i.e., high voltage and high current on interconnection leads 27,28. Moreover, it is more difficult to integrally encapsulate a switch and a relatively large capacitor (in the microfarad range) than to encapsulate a switch and diode, for example. For these reasons, interlock configuration 14*c*** is not preferred. A normally closed, open-to-run safety switch may, of course, be additionally or alternatively connected in parallel and encapsulated with capacitor C1.

The specific ignition circuit shown in the drawings illustrates only one type of capacitor-discharge ignition circuit with which the present invention may be used. Indeed, the invention is envisioned as being useful in connection with any type of engine ignition system in which a charge storage device such as a capacitor is connected in a charge path, and is alternately charged and then discharged through a parallel discharge path to initiate engine ignition. In its broader aspects, the invention is envisioned as contemplating a safety interlock system which prevents engine ignition upon occurrence of any one of a plurality of preselected unsafe conditions: i.e., unsafe condition of the safety switch or switches (open in FIGS. 1–3 and 5–6 and/or closed in FIG. 4), opening and/or grounding of either or both of interconnection leads (20,22 in FIGS. 1–4, 24,26 in FIG. 5 and 27,28 in FIG. 6), and direct electrical connection between the interconnection leads. The interlock system according to the invention broadly comprises a safety switch integrally encapsulated with an electrical component and connected in either the charge or discharge path of the ignition circuit, or in both the charge and discharge path in the case of the embodiment of FIG. 6, to prevent engine ignition upon occurrence of any one of the above-listed unsafe conditions.

Thus, in accordance with one aspect of the invention wherein the interlock system is disposed in the charge circuit path (e.g., FIGS. 1–4), charge current either is blocked from the ignition capacitor when an unsafe condition exists, is short circuited to ground or is collected on the charge capacitor and then dissipated prior to ignition triggering. In accordance with another aspect of the invention wherein the interlock system is connected in the discharge path (e.g., FIG. 5) and one of the above-noted unsafe conditions exists, capacitor charge is either short circuited to ground or collected on the capacitor but never discharged. In accordance with a third aspect of the invention wherein the interlock system is connected in both the charge and the discharge ignition path (e.g., FIG. 6) either charge collection is blocked by an open circuit when an unsafe condition is detected, the charge capacitor is short circuited, or charge is collected on the capacitor but not discharged through the ignition coil.

The invention claimed is:

1. In an apparatus including an engine having a capacitor-discharge engine ignition system having a timing cycle including a first component consisting of a charge storage capacitor, means connected to charge said capacitor through a charge path, a second component consisting of a unidirectional current rectifier means connected in said charge path in series with said capacitor to block the discharge of said capacitor through said charge path in the absence of an unsafe condition, and a third component consisting of a discharge triggering means connected to said capacitor through a discharge path and having a control terminal connected to receive a discharge control signal at a preselected time in the timing cycle, said triggering means discharging said capacitor through the discharge path when the discharge control signal is received by said control terminal, spark producing means connected in said discharge path such that said capacitor discharges therethrough and produces an ignition spark, all of said components being inherently essential to the proper operation of said ignition system, the improvement being a safety interlock system for preventing engine ignition upon the occurrence of an unsafe condition comprising: safety switch means movable between open and closed conditions and connected to one of said first, second and third components for disabling said one component to function in said ignition system by electrically isolating said one component from said ignition system when said switch means is one of said open and closed conditions, said switch means and said one component being disposed within an integrally encapsulated structure located remote from the other said components, said switch means being in one of said open and closed conditions on the occurrence of a preselected unsafe condition of said apparatus to electrically isolate the inherently essential component from the ignition system and render the ignition system inoperative.

2. The apparatus of claim 1 wherein said one component is said rectifier means, and said switch means is connected in series therewith and is opened on the occurrence of the unsafe condition.

3. The apparatus of claim 2 wherein said rectifier means is a diode.

4. The apparatus of claim 1 wherein said one component is said rectifier means and said switch means is connected in parallel therewith and is closed on the occurrence of said unsafe condition.

5. The apparatus of claim 4 wherein said one component is a diode.

6. The apparatus of claim 1 wherein said rectifier means comprises a SCR having an anode and a cathode connected in said charge path and a gate connected to said charge path to bias said SCR into conduction.

7. The apparatus of claim 1 wherein said rectifier means comprises a transistor having a collector and an emitter connected to said charge path and a base connected to said charge path to bias said transistor into conduction.

8. The apparatus of claim 1 wherein said one component is said triggering means which comprises a SCR having its anode and cathode connected in parallel with said capacitor, and said switch means connected in series with said anode and cathode.

9. The apparatus of claim 1 wherein said one component is said capacitor.

10. The apparatus of claim 1 including a charge coil connected in said charge path, a Zener diode connected across said charge coil to clamp voltage of one polarity developed in said charge coil to a preselected limit, and a rectifier connected in series with said Zener diode across said charge coil to prevent voltage in said charge coil of opposite polarity from developing a reverse current through said Zener diode.

11. The apparatus of claim 10 including impedance means connected across said charge coil to limit voltage of said opposite polarity developed in said charge coil.

12. The apparatus of claim 1 wherein said apparatus is a power lawn mower comprising a mower drive engine mounted on a support platform, a lawn mower handle mounted to said platform, a deadman switch actuator mounted on said mower handle and connected to actuate said switch means from one condition to the other when grasped by the person operating the lawn mower.

* * * * *

UNITED STATES PATENT AND TRADEMARK OFFICE

CERTIFICATE OF CORRECTION

PATENT NO. : 4,233,950

DATED : November 18, 1980

INVENTOR(S) : Kenneth L. Krolski and John Norman MacLeod

It is certified that error appears in the above-identified patent and that said Letters Patent are hereby corrected as shown below:

Col. 3, line 66, "64" should be added after "bracket"

Col. 4, line 33, "temperproof" should be -- tamperproof --.

Col. 5, line 68, "thereby" omitted between "reversed" and "effectively".

Claim 7, col. 9, line 19, "to" should be -- in --.

Signed and Sealed this

*Seventeenth* Day of *February 1981*

[SEAL]

*Attest:*

RENE D. TEGTMEYER

*Attesting Officer*

*Acting Commissioner of Patents and Trademarks*